US005292032A

United States Patent [19]

Johnson et al.

[11] Patent Number: 5,292,032

[45] Date of Patent: * Mar. 8, 1994

[54] PINCH TRIGGER WATER GUN WITH REARWARDLY MOUNTED HAND PUMP

[76] Inventors: Lonnie G. Johnson, 4030 Ridgehurst Dr., Smyrna, Ga. 30080; Bruce M. D'Andrade, 3 Ten Eyck Rd., Whitehouse Station, N.J. 08889

[ * ] Notice: The portion of the term of this patent subsequent to Sep. 29, 2009 has been disclaimed.

[21] Appl. No.: 872,952

[22] Filed: Apr. 22, 1992

Related U.S. Application Data

[63] Continuation-in-part of Ser. No. 841,762, Feb. 28, 1992, Pat. No. 5,150,819, which is a continuation of Ser. No. 680,247, Apr. 3, 1991, abandoned, which is a continuation-in-part of Ser. No. 578,145, Sep. 6, 1990, Pat. No. 5,074,437.

[51] Int. Cl.[5] ..... A63H 3/18

[52] U.S. Cl. ..... 222/79; 222/400.8; 222/401; 446/473

[58] Field of Search ..... 222/79, 130, 325, 396, 222/400.7, 400.8, 401; 42/54; 273/349; 446/473; 124/70, 73; 239/99

[56] References Cited

U.S. PATENT DOCUMENTS

| | | | |
|---|---|---|---|
| 2,589,977 | 3/1952 | Stelzer | 222/401 X |
| 3,197,070 | 7/1965 | Pearl et al. . | |
| 3,578,789 | 5/1971 | Ferri . | |
| 4,214,674 | 7/1980 | Jones et al. . | |
| 4,239,129 | 12/1980 | Esposito . | |
| 4,735,239 | 4/1988 | Salmon et al. . | |
| 4,854,480 | 8/1989 | Shindo . | |
| 5,074,437 | 12/1991 | D'Andrade et al. | 222/400.8 X |
| 5,141,132 | 8/1992 | Whelan | 222/79 |
| 5,150,819 | 9/1992 | Johnson et al. | 222/79 |

*Primary Examiner*—Gregory L. Huson
*Attorney, Agent, or Firm*—Kenneth P. Glynn

[57] ABSTRACT

The present invention is a toy water gun operated by selectively releasing water from a water reservoir that is pressurized with air. It is a one piece device formed in the general shape of a gun with a rearwardly mounted manually operated air pump for in the reservoir. The pressurized reservoir has an avenue of release that is regulated by a trigger mechanism. When no force is applied to the trigger, the pressurized water is held at bay with no means of release. When force is applied to the trigger, water is released from the pressurized reservoir and is channeled through a narrow nozzle to a stream of propelled water that lasts as long as the trigger is engaged or until the pressure on the water equals the ambient air. Water is added to the present invention via at least one fill opening on the water reservoir. The reservoir itself may be detachable or nondetachable from the gun housing.

19 Claims, 3 Drawing Sheets

PINCH TRIGGER WATER GUN WITH REARWARDLY MOUNTED HAND PUMP

REFERENCE TO RELATED CASES

This application is a continuation-in-part of copending U.S. patent application Ser. No. 07/841,762, filed on Feb. 28, 1992, by Bruce M. D'Andrade and Lonnie Johnson, for "Double Tank Pinch Trigger Pump Water Gun", now U.S. Pat. No. 5,150,819 and which is a File Wrapper continuation of U.S. patent application Ser. No. 07/680,247, filed on Apr. 3, 1991, abd, having the same inventors and title, which is a continuation-in-part of previously copending U.S. patent application Ser. No. 07/578,145, filed on Sep. 6, 1990, having the same inventors, for "Pinch Trigger Pump Water Gun", now U.S. Pat. No. 5,074,437, issued on Dec. 24, 1991.

BACKGROUND OF THE INVENTION

1. Field of the Invention

The present invention is directed to a toy water squirt gun, and more particularly to a pressurized toy water squirt gun that uses self-contained means of pressurizing a water reservoir with air, creating a pressure differential between the contained water and the ambient atmosphere that propels water from the toy either in a continuous stream or in a selective manner. The pressure differential is achieved by pumping a rearward mounted hand pump.

2. Description of the Prior Art

Water guns have for decades been a very popular child's toy. Since the toy industry is very competitive, hundreds of different style water guns have been developed in an attempt to profit from the toy's inherent popularity. The most traditional forms of water guns are activated by a pumping action, either manually through the trigger or automatically through a battery operated motor. Such pump action water guns work, but the guns are limited in the distance the water traveled, the amount of water projected and the duration of the pumping cycle. In an attempt to improve upon water guns, the toy industry has developed pressure activated water guns. Such pressure activated water guns work upon the principle of pressure differentials between the water held within the toy and the atmosphere. The water within the toy is subjected to a pressure higher than that of the ambient air. As a result, when the water within the toy is given an avenue of escape, the water will stream out under pressure.

Two primary types of pressure activated water toys exist. The first type is when the water itself is worked to a pressure higher than that of the ambient air. This type of water gun is exemplified by the following:

U.S. Pat. No. 3,197,070 to Curtis F. Pearl et al, shows a water gun activated by trapping water in a collapsible area. As the device is collapsed, the pressure of the water builds, spraying the water out of the one small orifice left within the pressured area. Once the confined area is fully collapsed, the re-expansion of the area draws forth more water from a reservoir, thus priming the water gun for another cycle.

U.S. Pat. No. 4,854,480 to Robert S. Shindo and U.S. Pat. No. 4,735,239 to Michael E. Salmon et al, both show toy water devices that use an elastic bladder to pressurize water. The bladders are filled with high pressure water, and the bladders respond by elastically deforming. The source of pressurized water is then removed and the water within the expanded bladder is held in place by a clamping device activated by a trigger. The water gun is used by selectively releasing the clamp, allowing the water to flow from the expanded bladder.

The second type of pressure activated water toys are toys that use air pressure to force water through squirt channels. Such toys that use this technology are exemplified by U.S. Pat. No. 4,214,674 to Jones et al. The Jones patent shows a two piece apparatus consisting of a pressurized water reservoir and a discharging gun. The Jones patent had a hand operated air pump but differs from the present invention in that it does not have a one piece self contained pressurization system and lacks the valve configuration needed to support such a self contained system. Additionally, the present invention has the capability of working at very high pressure and incorporates safety criteria into its design to eliminate the inherent dangers of high pressure liquids.

U.S. Pat. No. 4,239,129 to Gary F. Esposito describes a water pistol and/or flashlight structure which includes a reciprocal pump within a liquid chamber of tank located itself within the gun housing. The pump is used to pressurize air within the tank after water has been added, and a trigger is used for subsequent release of the water. Battery operated lights and sound are also provided.

U.S. Pat. No. 3,578,789, issued to Giampiero Ferri, describes a water pistol which includes a main liquid reservoir and a pressurized liquid reservoir contained within the main liquid reservoir. The trigger-actuated pump is used with a manually operated three way valve to selectively supply liquid: (a) from the pump to the pressurized reservoir; (b) from the pump to the nozzle and to the pressurized liquid reservoir; or, (c) from the pressurized liquid reservoir. The Ferri water gun is limited in many ways as compared to the present invention. Ferri does not have a separate hand pump but relies only upon the trigger as a pump (limited to finger pumping). Ferri requires manual valve switching with complicated steps not easily performed by young children. Ferri has limited liquid capacity as the main liquid reservoir is inside the housing (handle) and is very limited in pressurized tank capacity as the Ferri pressurized tank is within the main liquid reservoir. The present invention water gun uses a pump separate from the trigger, does not require switching and has one or more tanks for increased capacity which are non-detachable and external from the housing.

Thus, prior art does teach use of toy water guns that operate by the pressurization of stored water, but, the prior art does not teach or suggest a toy water gun that has a self-contained means of pressurizing stored water with air, and has a value configuration that allows pressurized air and water to enter and exit the stored water reservoir through and by the same opening. Thus, allowing the present invention water gun to be a one piece unit and to have a high pressurization capacity results in ease of both use and manufacturability. Also, prior art fails to teach or suggest the use of highly pressurized air with water toys and fails to recognize the needed design criteria and safety allowances to eliminate the traditional hazards of producing, storing and discharging high pressure liquids.

SUMMARY OF THE INVENTION

The present invention is a high pressure, self-contained, air pressured toy water gun. It includes a housing having a forward end and a rearward end, an extended handle connected to the housing, a trigger located on the housing adjacent said handle and a barrel portion of said housing extending forwardly from the handle. There is at least one high pressure, water storage reservoir externally attached to the housing, the reservoir having an orifice with connection means connected to the housing. An attachment means is located on the water gun housing for attaching the water storage reservoir to the water gun housing by attachment of the connection means of the orifice to the attachment means, and, when the water storage reservoir is attached to the housing, the attachment means seals the reservoir and housing with a seal impervious to water and air. There is a pressuring means with a slider, for pressurizing air within the reservoir, the means being an integral part of the water gun and being rearwardly mounted in a handle extending rearwardly from said housing with the slider extending from the housing. An elongated avenue of release for water displaced by the pressurized air is included, with the avenue of release extending from the attachment means and running the length of the barrel, and there is a water release means for regulating the fluid flow through the avenue of release, with the water release means being operable by the trigger and functionally connected to the avenue of release, and, a nozzle is at the end of said barrel connected to the avenue of release.

BRIEF DESCRIPTION OF THE DRAWINGS

The invention will be more fully understood by referring to the following detailed specifications, the above specification and the claims set forth herein, when taken in connection with the drawings appended hereto, wherein:

DETAILED DESCRIPTION OF THE PRESENT INVENTION

Figure 3:
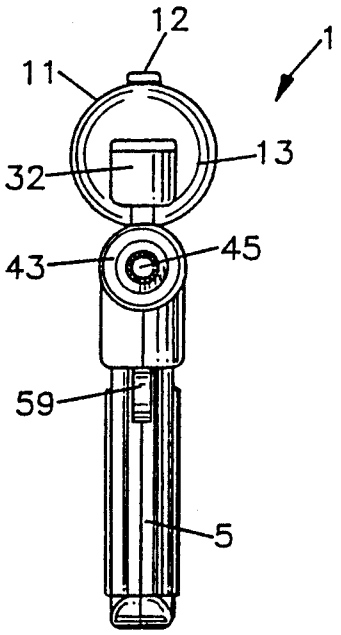
FIG. 3 shows the front view of the preferred embodiment expressed by FIGS. 1 and 2.

The present invention is, as mentioned, directed toward a toy water gun that uses air to pressurize water and propel the water through a narrow nozzle. Pressurized water toys are not new; they have been in existence for decades. Water pressure has been used in the toy industry for everything from launching toy rockets to propelling toy cars. Pressurized water toys come in two primary types. First there are water toys that use mechanical means to directly compress and pressurize water. Such toys represent a majority of the water toys manufactured today, and are exemplified by traditional water guns that use a trigger operated pump or a battery powered motor to squirt small amounts of water. The problem with toys that directly pump water is that to get the required pressure for a satisfactory squirt, a small diameter piston is required. This in turn limits the amount of water that can be squirted in each shot. In addition, the speed at which the pump is activated, whether manually or by motor, affects the distance of the shot, and it requires many cycles to project any significant amount of water.

To solve these problems, toy manufacturers have turned to the technology of compressed air to pressurize a reservoir of water. Air is easily compressed to high pressures and this high pressure can be transferred to stored water. This technology is easily adapted to a child's strength and allows a relatively large amount of water to be pressurized at one time. This large reserve of pressurized water allows a water gun to fire a large continuous stream of water at one time or multiple single streams of water sequentially without the need for repeated pumping cycles.

The problem with air pressurized toys is one of safety. Toys are designed to be inexpensive so as to be widely marketable. As such, most toys are made of plastics or other inexpensive materials. Such materials do not have large tensile strengths or fatigue characteristics, and therefore do not lend themselves well to containing pressurized fluids. Plastic containers for pressurized liquids, if not properly designed, can rupture and explode causing severe injury.

The present invention has a unique design that allows for both the use of high pressure air and the elimination of potential rupturing hazards. The present invention has a cylindrical water reservoir which is external to the housing and formed of essential thickness and shape to maximize capacity and safety, and may be permanently attached to the housing or may be detachable. One or more tanks or reservoirs are utilized and preferably have rounded cylinder ends which serve to maintain the integrity of the water reservoir walls and minimize the leak points throughout the material of the water reservoir, thereby allowing for the safe use for higher pressures. A single orifice connection from the water reservoir to the housing was designed so that both the pressurized air from the air pump and the exiting pressurized water utilize the same opening without backflow problems to either. Additionally, since the water reservoir must be periodically refilled with water, a separate fill opening and cap are provided on permanently attached reservoirs so that water can be added at ambient pressure. On removable reservoirs, the connecting orifice may also serve as the fill port.

The present invention water gun is operated by filling the reservoir(s), pumping up the pressure by the rearwardly mounted hand pump and selectively releasing the pressurized water through a narrow nozzle. The selective release of the pressurized water is controlled by the trigger mechanism of the water gun which is separate from the pump mechanism. Since the present invention has the ability to operate at high pressures, the trigger release mechanism performs two functions. First it controls the amount of water released and, second, the trigger mechanism serves as a safety valve. The trigger of the present invention has an extension that pinches the exit hosing of the pressurized water. The pinching force is created by a spring. When the trigger is pressed, the spring bias of the pinching member is overcome and water is released. Similarly, when the pressure in the water reservoir extends beyond safety limitations, the force of the pressurized water will overcome the spring bias of the pinching member allowing water to be released until t he pressure within the reservoir reaches a safe level.

The present invention is thus directed toward a toy water gun which is operated by selectively releasing water from a water reservoir that is pressurized with air. The present invention is a one piece device formed in the general shape of a gun that has a manually operated air pump incorporated into the design which is rearwardly mounted. The air pump pressurizes a water reservoir and consequently pressurizes any water found therein. The pressurized water has an avenue of release that is regulated by the trigger mechanism of the invention. When no force is applied to the trigger, the pressurized water is held at bay with no means of release. When force is applied to the trigger, water is released from the pressurized container and is channeled through a narrow nozzle. The escape of the pressurized water through the narrow nozzle creates a stream of propelled water that lasts as long as the trigger is engaged or until the pressure on the water in the reservoir equals the ambient air pressure. Water is added to the present invention via at least one fill opening on the water reservoir from the gun, and the reservoir itself may be detachable or non-detachable. There is an orifice on the water reservoir which may be the same as the fill opening for detachable reservoirs or separate from the fill opening for detachable or non-detachable reservoirs. This orifice is connected to the housing and serves as both the entrance point of pressurized air from the air pump, and the exit point of the pressurized water. The water reservoir may be formed apart from the housing so that the integrity of the reservoir's walls remains intact, allowing the water reservoir to hold high pressures without fear of rupture. Additionally, the danger of rupture is eliminated by a triggering device that automatically and safely discharges pressurized water when over pressurized, but does not release the water automatically until the maximum allowable pressure is reached.

Figure 1:
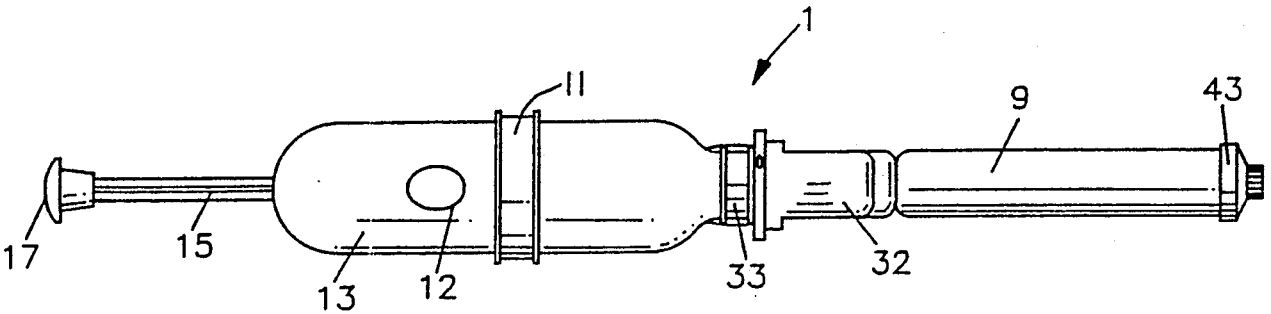
FIG. 1 shows the top view of one preferred embodiment of the present invention.
Figure 2:
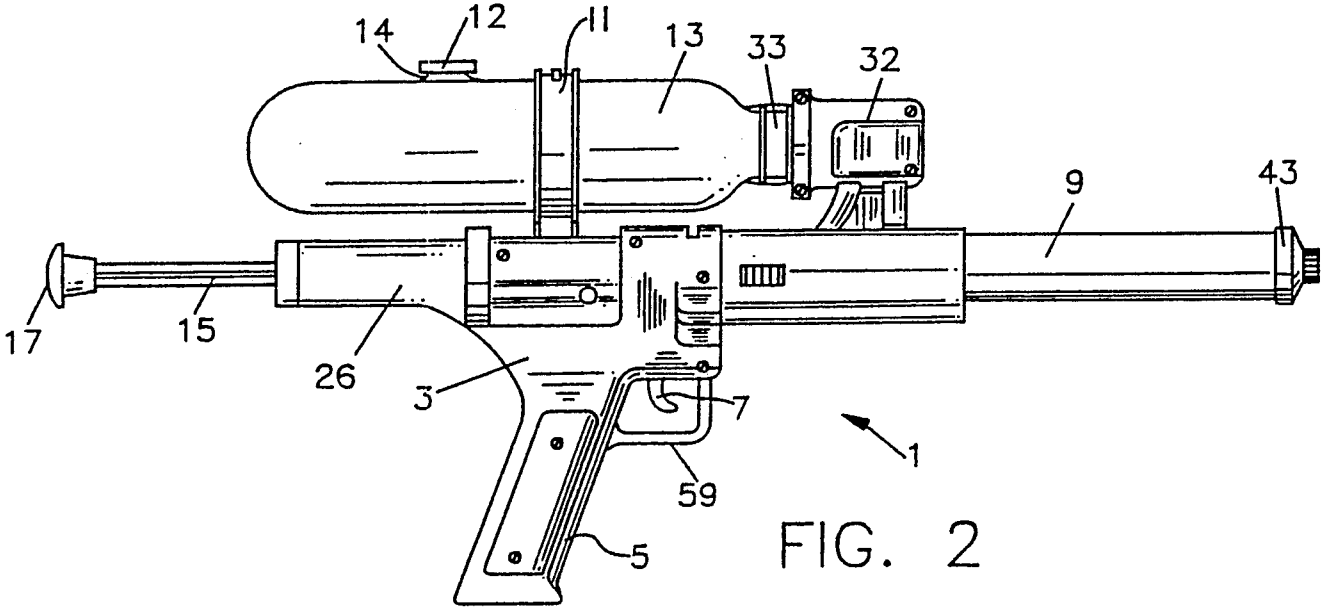
FIG. 2 shows the side view of the preferred embodiment expressed in FIG. 1.

Referring now to FIGS. 1, 2 and 3 there are shown the respective top, side and front vies of one preferred embodiment of the present invention water gun 1 with like parts being like numbered. Shown from these figures is the general gun like shape of the embodiment water gun 1, having a main housing 3 with extending barrel 9, trigger 7, and handle 5. A trigger guard 59 extends around the trigger 7 from the handle 5 to the main housing 3. In this embodiment, the permanently attached water reservoir 13 is held to the main housing 3 via an attachment collar 11 and reservoir mount 33. Non-reversing threads and/or gluing or heat sealing may used to permanently attach the water reservoir 13 to the housing 3. Alternatively, the reservoir could be integrally formed with the housing but separate formation for minimum seams and maximum safety is preferred. Yet, alternatively in the other embodiments, the reservoir may be removable. The air pump of the present invention is embodied within the main housing 3 but the handle to the pump is a slider handle 17 connected to pump rod 15 that extends rearwardly and is mounted as shown. It travels along, and is guided by the slider encasement 26, a portion of housing 3. Water is supplied by removal of cap 12 from fill port 14 and filling reservoir 13 therethrough.

Figure 4:
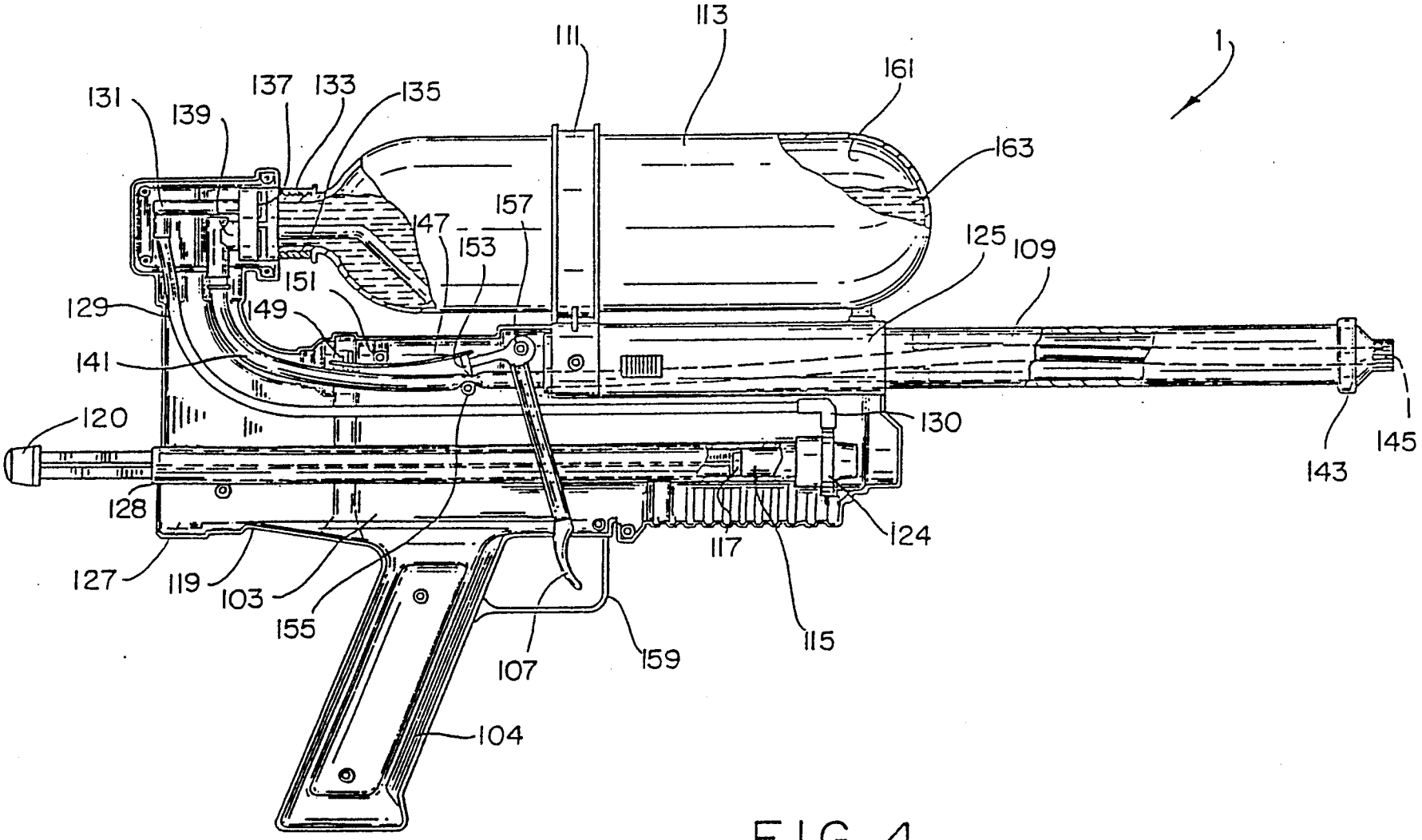
FIG. 4 shows a selective side view of another preferred embodiment of the present invention with sections removed to better show interior mechanisms; and, FIG. 5 illustrates an alternative embodiment of the present invention water gun having multiple reservoirs.

Referring now to FIG. 4, the operation of an alternative present invention embodiment is shown. FIG. 4 is a partially cut side view of a present invention embodiment with selective portions of the main housing 103, water reservoir 113 and barrel 109 removed.

The water reservoir 113 is cylindrical and has an orifice 135 with a threaded collar which may be temporarily sealed to reservoir mount 133. When reservoir 113 is securely screwed into mount 133, the reservoir mount 133 forms a selective watertight and airtight seal between the reservoir 113 and the main housing 103. Thus the water reservoir 113 and the main housing 103 are sealed from the ambient environment, the only water and air passing between these components through valve means described below, until the reservoir 113 was subsequently unscrewed.

To fill the water reservoir 113 with water 163, the water reservoir 113 is removed from the mount 133 by unscrewing, is filled with water 163 then placed into the reservoir 113 and the reservoir 113 at threaded orifice 135 is rethreaded into a sealed airtight position. The reservoir may have any capacity desired, and reservoirs having a capacity of one half liter or more is advantageous.

Once filled with water 163, the water gun 101 is operated by pressurizing the water reservoir 113 with air in space 161 above the water 163. Air is forced into the reservoir 113 by the relative movement of the piston 117 within the air pump cylinder 115. The piston 117 is operated by the pump rod 119 that connects the piston 117 to the slider handle 120, which, with rod 119 extends rearwardly and is held within extended casing 127 and seal 128 of housing 103. The pump rod 119 is anchored to the slider handle 120, as shown. The slider handle 120 is operated manually by the user of the water gun 101. A user holds the slider handle 120 with one hand and the gun handle 105 with the other. The slider handle 120 is then moved back and forth along the length of housing 103 within cylinder 115. The back and forth action is transferred to the piston 117, which forces air past a one way flow valve 124, through elbow tubing 130 a length of flexible air flow tubing 129 and elbow tubing 131, through a water backflow prevention flap 137 and into the water reservoir 113. Air is continuously added to the water reservoir 113 until a desired pressure is reached.

Once under pressure, the water 163 is selectively prevented from flowing freely through the conduit or avenue of release, comprising the outlet tubing 139 and 141 by a water release means. A preferred release means as shown in this embodiment includes a spring biased pinch bar 153 that clamps the outlet tubing 141 against a stop 155 that is part of the main housing 103. Preferably, all of the tubing may be flexible tubing or at least a portion is flexible when a pinch bar is used as the water release means. The pinch bar 153 is biased against the stop 155 by a calibrated spring 147. The spring is held at one end by a formation 149 of the main housing 103 and is stressed by being deformed over a pivot 151. The strength of the spring 147 in its biased configuration is calibrated, so that when the pressure on the water 163 within the outlet tubing 141 reaches a predetermined maximum value, the spring 147 will allow the pinch bar 153 to rise and water 163 will be released until safe pressure is maintained. Thus, the predetermined maximum value for the yielding of the spring 147 or other release means may preferably be between 50 pounds per square inch and 90 pounds per square inch. Other predetermined pressures of higher or lower value e.g. 100 pounds per square inch may be used depending upon the particular components and specific configuration of a particular embodiment.

Other than the automatic water release for an overly high pressure, water 163 is released in the following manner. Rearwardly directed force is applied to the trigger 107, and is transferred to the pinch bar 153 via the levered configuration of the trigger 107 that rotates around pivot 157. The transferred force applied to the pinch bar 153 acts in opposition to the biasing force of spring 147. When the force of the trigger 107 overcomes the force of the spring 147 the pinch bar 153 is lifted from the outlet tubing 141 and water 163 is allowed to pass through pick up tube of tank 113, elbow 139 and then through the outlet tubing 141 within the barrel 109. The barrel outlet tubing 141 terminates at a nozzle 143 that has a narrow opening 145. Water 163 streams out of the narrow opening 145 until either the force on the trigger 107 is released or until the air pressure within the water reservoir 113 reaches ambient.

Figure 5:
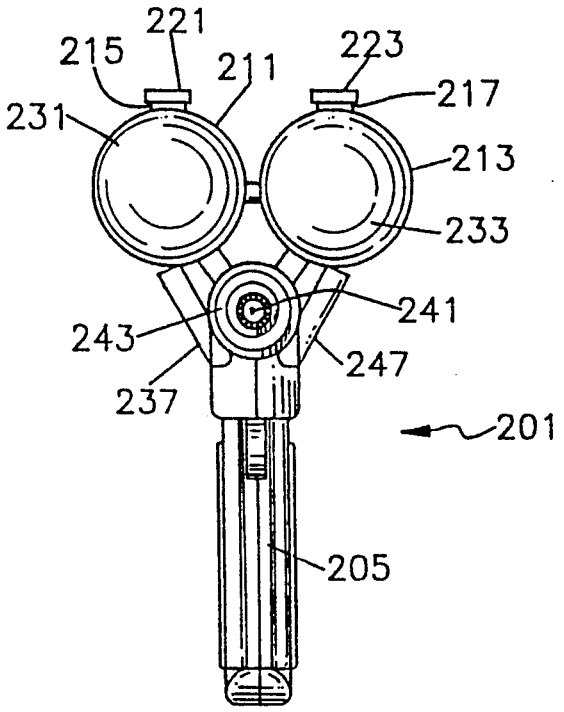

Referring now to FIG. 5, a front view of alternative present invention water gun 201 is shown. It is similar to water gun 101 discussed above and operates in the same manner. Thus, all of the pumping and squirting features (not shown) are similar. Likewise, nozzle 243 and narrow opening 241 operate like those in water gun 101. Here, however, two reservoirs, 231 and 233, are included. Reservoir supports 237 and 247 are connected to the rear portions of reservoirs 231 and 233 (not shown) and contain inlet and outlet tubing and backflow prevention flaps, as discussed in conjunction with water gun 101, above. Attachment collars 211 and 213, along with supports 237 and 247, hold reservoirs 231 and 233 in place. Instead of using the attachment orifices, they are filled via fill ports 215 and 217, covered by caps 221 and 223. In operation, reservoirs 231 and 233 are filled and capped independently. They are connected via tubing in parallel, i.e. the pump pumps to both reservoirs simultaneously, and the trigger releases water from both simultaneously. In the alternative, the reservoirs could be used in series, and less desirable manual reservoir switching may be included.

It should now be understood that although the invention described within the above specification shows preferred embodiments of the present invention, the invention may be formed, shaped, practiced, or made of differing materials than are specifically described within.

What is claimed is:

1. A high pressure, self-contained, air pressured toy water gun, which comprises:

(a) a housing having a forward end and a rearward end;

(b) an extended handle connected to said housing;

(c) a trigger located on said housing adjacent said handle;

(d) a barrel portion of said housing extending forwardly from said handle;

(e) at least one high pressure, water storage reservoir externally attached to said housing, said reservoir having an orifice with connection means connected to said housing;

(f) an attachment means located on said water gun housing for attaching said water storage reservoir to said water gun housing by attachment of said connection means of said orifice to said attachment means, and, when said water storage reservoir is attached to said housing, said attachment means seals said reservoir and housing with a seal impervious to water and air;

(g) a pressuring means with a slider, for pressurizing air within said reservoir, said means being an integral part of said water gun and being rearwardly mounted in a handle extending rearwardly from said housing and said slider extending from said housing, said pressurizing means being remotely located from said reservoir;

(h) an elongated avenue of release for water displaced by said pressurized air, said avenue of release extending from said attachment means and running the length of said barrel;

(i) a water release means for regulating the fluid flow through said avenue of release, said water release means being operable by said trigger of said water gun and functionally connected to said avenue of release; and, (j) a nozzle at the end of said barrel, said nozzle being connected to said avenue of release.

2. The invention of claim 1, wherein said water storage reservoir is designed to hold at least 100 pounds per square inch of pressure.

3. The invention of claim 1, wherein airflow from said reservoir to said pressurizing means is prevented by a one way flow device.

4. The invention of claim 1, wherein waterflow from said reservoir into said pressurizing means is prevented by a one way flow device.

5. The invention of claim 1, wherein said nozzle has a narrow orifice therethrough with a cross-sectional area less than that of said avenue of release.

6. The invention of claim 1, wherein said attachment means has an elongated hollow member depending therefrom, said elongated hollow member extending through said orifice of said reservoir and terminating at the lowest point within said reservoir.

7. The invention of claim 1, wherein said pressurizing means is a hand operated air pump.

8. The invention of claim 7, wherein said air pump has a pumping stroke action along an axis parallel to said barrel.

9. The invention of claim 8, wherein said hand pump has a slider handle extending rearwardly.

10. The invention of claim 1, wherein said avenue of release is a flexible tube connecting said attachment means with said nozzle.

11. The invention of claim 10, wherein said water release means is a spring biased pinch bar that clamps said avenue of release thus selectively restricting the water flow therethrough.

12. The invention of claim 11, wherein said spring biased pinch bar has a spring bias which is calibrated to yield to pressure within said avenue of release, when said pressure within said avenue of release exceeds a predetermined maximum value.

13. The invention of claim 12, wherein said maximum value for the yielding of said spring bias to pressure within said avenue of release is between 50 pounds per square inch and 90 pounds per square inch.

14. The invention of claim 11, wherein said spring biased pinch bar is formed as part of said trigger and said spring biased pinch bar has a spring biased which is overcome by a force applied to said trigger through a lever action, causes said pinch bar to move in opposition to said spring bias.

15. The invention of claim 14, wherein said spring bias is formed by a straight spring having two ends, one end being anchored to said housing and the other end engaging said pinch bar.

16. The invention of claim 15, wherein said attachment means has an elongated hollow member depending therefrom, said elongated hollow member extending through said orifice of said reservoir and terminating at the lowest point within said reservoir.

17. The invention of claim 1, which includes two of said reservoirs.

18. The invention of claim 6, which includes two of said reservoirs.

19. The invention of claim 11, which includes two of said reservoirs.

* * * * *